United States Patent [19]

Suzuki et al.

[11] Patent Number: 4,509,354

[45] Date of Patent: Apr. 9, 1985

[54] METHOD OF MANUFACTURING FAN GUARD

[75] Inventors: Akio Suzuki; Mitsuo Akiyama; Hideo Uzuhashi; Izumi Ochiai, all of Tochigi; Hitoshi Yamashita, Ashikaga; Youji Sekine, Tochigi; Katsuo Matsui, Utsunomiya; Syuji Tomita, Tochigi, all of Japan

[73] Assignee: Hitachi, Ltd., Tokyo, Japan

[21] Appl. No.: 403,017

[22] Filed: Jul. 29, 1982

[30] Foreign Application Priority Data

Apr. 22, 1981 [JP] Japan ..... 56-59884

[51] Int. Cl.[3] ..... B21D 53/00; B21D 53/80

[52] U.S. Cl. ..... 72/294; 72/308; 72/310; 72/70; 72/125; 72/324; 72/379; 29/163.5 R; 98/121.1

[58] Field of Search ..... 72/324, 325, 298, 299, 72/294, 295, 308, 310, 311, 304, 379, 68, 70, 112, 125, 64; 29/163.5 R, 6.1; 98/121 R, 114, 99.8, 94 AC; 62/262

[56] References Cited

U.S. PATENT DOCUMENTS

| | | | |
|---|---|---|---|
| 1,208,241 | 12/1916 | Varley | 29/6.1 |
| 1,287,298 | 12/1918 | Halvorson et al. | 29/163.5 R |
| 2,395,578 | 2/1946 | Pergande | 98/121 R |
| 2,492,909 | 12/1949 | Warp | 72/324 |
| 3,090,337 | 5/1963 | Lyon | 72/379 |
| 3,258,954 | 7/1966 | Dennis | 72/294 |
| 3,618,185 | 11/1971 | Coen | 29/6.1 |

*Primary Examiner*—Daniel C. Crane

*Attorney, Agent, or Firm*—Antonelli, Terry & Wands

[57] ABSTRACT

A method of manufacturing a fan guard from a plate member wherein inward slits, each having at least a radial slit section are formed in a first section of the plate member located between a central section and a ring-like section radially outwardly spaced therefrom of the plate member such that the radial slit sections extend from the central section to the ring-like section in circumferentially spaced relation to each other. Radially outward slits, each having at least an arcuate slit section, are formed in a second section of the plate member located between the ring-like section and an outer peripheral section of the plate member such that the arcuate slit sections extend from the ring-like section to the outer peripheral section in circumferentially spaced relation to other. Portions each extending between the adjacent two radial slit sections are bent to form louvers. The central, first and ring-like sections are offset from the outer peripheral section while rotating the central, first and ring-like sections relative to the outer peripheral section, to twist portions extending between the adjacent two arcuate slit sections to form louvers.

4 Claims, 6 Drawing Figures

METHOD OF MANUFACTURING FAN GUARD

BACKGROUND OF THE INVENTION

Field of the Invention

The present invention relates to a method of manufacturing a guard for protecting a fan or blower (hereinafter simply referred to as "fan") and, more particularly, to a method of manufacturing a guard suitable for use in a propeller type fan.

Summary of the Invention

An object of the present invention is to provide a fan guard manufacturing method which is capable of preventing vibration noise from occurring during operation and is capable of considerably improving the manufacturing efficiency.

In accordance with the present invention, a method of manufacturing a fan guard from a plate member is proposed which comprises the steps of forming a plurality of radially inward slits, each having at least a radial slit section in a first section of the plate member, with the first section extending between a central section of the plate member and a ring-like section thereof radially outwardly spaced from the central section,, the radial slit sections radially extending in the first section from the central section to the ring-like section in circumferentially spaced relationship to each other. Forming a plurality of arcuate radially outward slits each having at least one arcuate slit section in a second section of the plate member, the second section extending between the ring-like section and the outer peripheral section of the plate member radially outwardly spaced from the ring-like section, the arcuate slit sections extending from a ring-like section to the outer peripheral section in circumferentially spaced relationship to each other. Bending portions of the first section each extending between the adjacent two radial slit sections to form louvers, and offsetting the central section, the first section, and the ring-like section from the outer peripheral section while rotating the central section, the first section and ring-like section relative to the outer peripheral section, to twist portions of the second section each extending between the adjacent two arcuate slit sections to form louvers.

DETAILED DESCRIPTION

Figure 1:
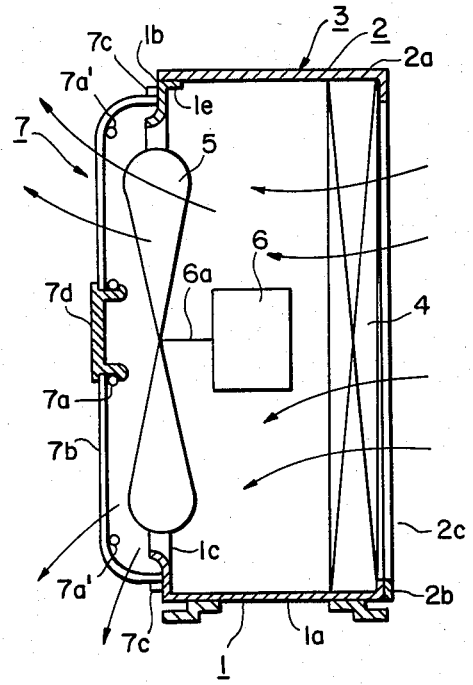
FIG. 1. PRIOR ART
FIG. 1 is a cross-sectional view of an air conditioner having a conventional fan guard.
Figure 2:
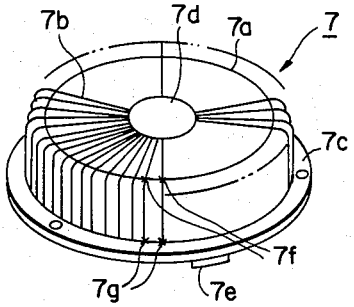
FIG. 2. PRIOR ART
FIG. 2 is a perspective view of the conventional fan guard shown in FIG. 1.

Referring now to the drawings wherein like reference numerals are used throughout the various views to designate like parts and, more particularly, to FIGS. 1 and 2, according to these figures, a conventional air conditioner comprises a casing 3 which includes an L-shaped first casing member 1 made of a steel and having a planar first wall or base wall 1*a* and a planar second wall 1*b* generally perpendicular thereto. The first wall 1*a* has an upstanding flange 1*d* at the edge of the first wall opposite to the second wall 1*b*. The second wall 1*b* has formed therein a circular opening 1*c* and a flange 1*e* at the edge of the second wall opposite to the first wall 1*a*. The casing 3 further includes an L-shaped second casing member 2 made of a steel and having a planar first wall 2*a* and a planar second wall 2*b* generally perpendicular thereto. The second wall 2*b* has formed therein a rectangular opening 2*c* serving as an air suction opening. Upon the assembly of the casing 3, the first wall 2*a* of the second casing member 2 is secured to the flange 1*e* on the second wall 1*b* of the first casing member 1 and the second wall 2*b* of the second member is secured to the flange 1*d* on the first wall 1*a* of the first casing member 1. Thereafter, side wall members 21, only one of which is seen in FIG. 1, are secured to the first and second casing members 1 and 2 so that the casing 3 is completed. A heat-exchanger 4 is disposed within a space defined in the casing 3 and located adjacent to the suction opening 2*c* in the second wall 2*a* of the second casing member 2. A propeller type fan 5 is disposed in the circular opening 1*c* provided in the second wall 1*b* of the first casing member 2. A motor 6 is disposed within the space in the casing 3 and is drivingly connected to the propeller type fan 5 through an output shaft 6*a*. As the fan 5 is rotated, air is drawn through the suction opening 2*c* and the heat-exchanger 4 into the space within the casing, whereupon the heat-exchanging is performed with respect to the air by means of the heat-exchanger 4. The air drawn into the space within the casing 3 is discharged through a fan guard 7. The fan guard 7 is mounted on the second wall 1*b* of the first casing member 1 so as to cover a portion of the fan 5 projecting outwardly from the second wall 1*b*. As will be clearly seen from FIG. 2, the fan guard 7 comprises radially spaced inner and outer rings 7*a* and 7*a'* made of wire, an attaching ring 7*c*, a plurality of spokes 7*b* bent in an L-shape, made of wire and radially extending from the inner ring 7*a* to the attaching ring 7*c* through the outer ring 7*a'*, a disc-like cap 7*d* fitted in the inner ring 7*a*, and cushioning or buffer members 7*e* secured to the attaching ring 7*e*.

The fan guard 7 shown in FIG. 2 is manufactured in the following manner: a welding is performed at contact points 7*f* between the inner and outer rings 7*a* and 7*a'* and the spokes 7*b*, and then a welding is performed at contact points 7*g* between the spokes 7*b* and the attaching ring 7*e*; thereafter, the disc-like cap 7*d* is fitted in the inner ring 7*a*; and the buffer members 7*e* are secured to the surface of the attaching ring 7*c* opposite to the inner and outer rings 7*a* and 7*a'*. The buffer members 7*e* are provided for preventing vibration noize from occuring during the operation of the air conditioner. The vibration noise occurs, if a gap is left between the first wall 1*b* of the first casing member 1 and the fan guard 7 upon the attachment of the fan guard 7 to the casing member. According to the manufacturing method described above, it is difficult to confirm whether the spokes 7*b* are reliably welded to the inner and outer rings 7*a* and 7*a'* and to the attaching ring 7*e* at the contact points 7*f* and 7*g*, respectively. Should some of the welded contact points be incomplete or a failure in welding occur, vibration noize would occur during the operation of the air conditioner, or a danger would arise in that, when a finger of a human being contacts with the spokes 7*b*, the spokes are offset from their positions so that the finger passes through a spacing between the adjacent two spokes and abuts against the fan 5. In addition, since the fan guard 7 is arranged so as to comprise a plurality of rings 7*a* and 7*a'*, a multiplicity of bent spokes 7*b*, attaching ring 7*c*, cap 7*d* and buffer members 7*e*, a great number of parts are required for the fan guard 7. Further, because the spokes 7*b* are required to be welded at a constant pitch, a great number of manufacturing steps are required for the manufacturing of the fan guard 7.

Figure 4:
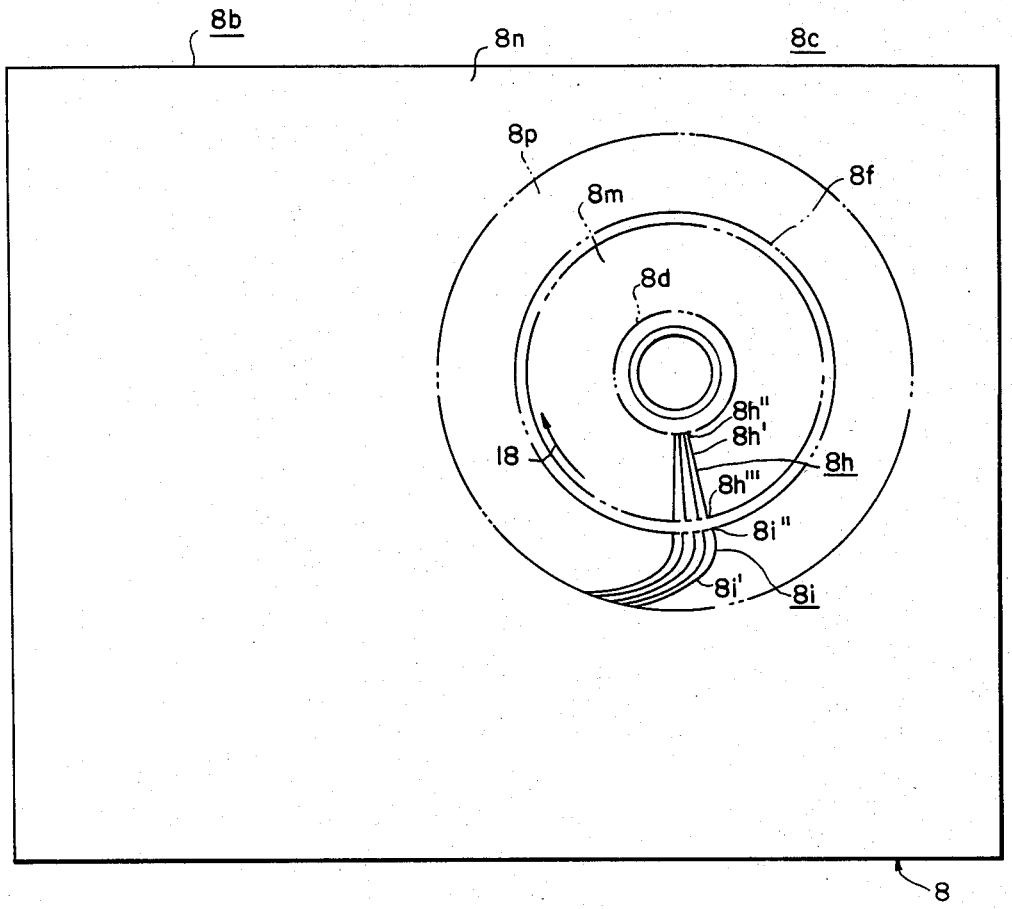
FIG. 4 is a plan view of a planar plate member prior to a bending of the plate member to form an L-shaped first casing member, radially inward and outward slits being formed in the plate member by means of a tooth die assembly.
Figure 5:
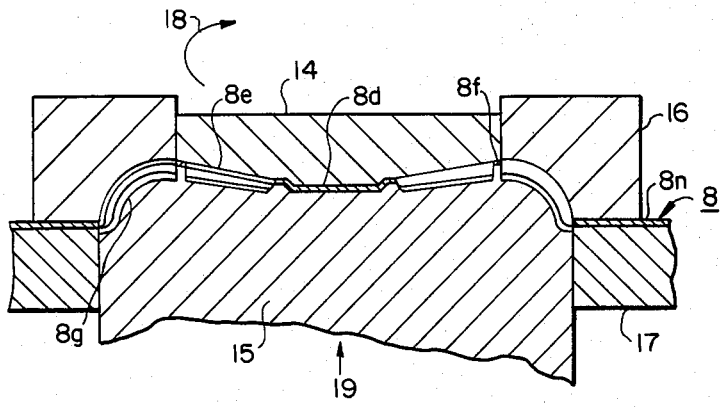
FIG. 5 is a cross sectional view of a manufacturing step in which louvers are formed by a forming die assembly.
Figure 6:
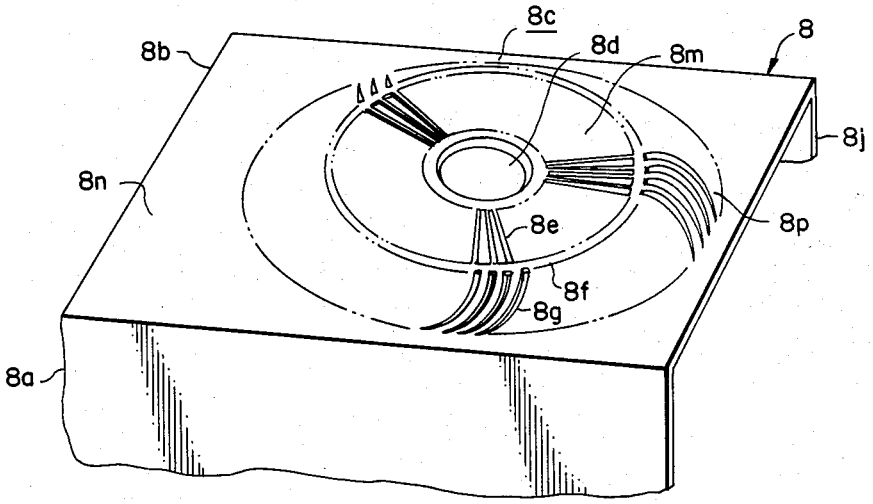
FIG. 6 is a perspective view of a fan guard formed integrally with a casing member constituting a part of a casing of the air conditioner shown in FIG. 3.

As shown in FIGS. 3–6, an air conditioner having incorporated therein a fan guard 8*c* manufactured by the method in accordance with the present invention comprises a casing generally designated by the reference numeral 10 which includes an L-shaped first casing member made of a steel and having a planar first wall or base wall 8*a* and a planar second wall 8*b* generally perpendicular thereto. The second wall 8*b* has formed integrally therewith a flange 8*j* at the edge of the second wall opposite to the first wall 8*a*. The second wall 8*b* also has formed integrally therewith the fan guard 8*c* outwardly projecting the second wall 8*b*. The fan guard 8*c* comprises, as best shown in FIG. 6, a central disc-like section 8*d*, a ring-like section 8*f* radially outwardly spaced from the central disc-like section, a plurality of louvers 8*e* formed in a first annular section 8*m* extending between the central disc-like section 8*d* and the annular section 8*f*, an outer peripheral planar section 8*n* radially outwardly spaced from the ring-like section 8*f*, and a plurality of louvers 8*g* formed in a second annular section 8*p* extending between the ring-like section 8*f* and the outer peripheral section 8*n*. The louvers 8*e* formed in the first annular section 8*m* are integrally connected to the disc-like section 8*d* and the ring-like section 8*f* and radially extend therebetween in circumferentially equi-distantly spaced relation to each other. Similarly, the louvers 8*g* are connected in an integral manner to the ring-like section 8*f* and the outer peripheral section 8*n* and radially extend therebetween in circumferentially equi-distantly spaced relation to each other. As described above, since the fan guard 8*c* is arranged such that the radially extending louvers 8*e* are connected in an integral manner to the central disc-like section 8*d* and the ring-like section 8*f* and the radially extending louvers 8*g* are connected in an integral manner to the ring-like section 8*f* and the outer peripheral section 8*n*, it is unnecessary to confirm whether the welded points are complete, as is in the previously described conventional air conditioner, no vibration noize due to incomplete welded points occurs, and there is no danger that a finger passing through the fan guard and abutting against a fan 13.

Figure 3:
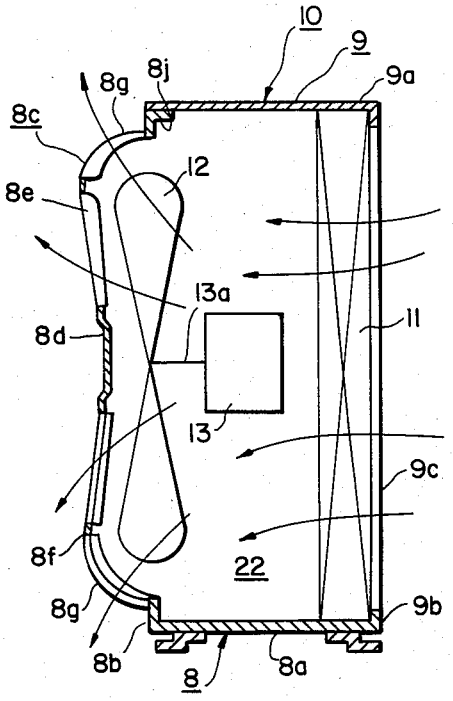
FIG. 3 is a cross-sectional view of an air conditioner having incorporated therein a fan guard manufactured by a method in accordance with an embodiment of the present invention.

The casing 10 further includes an L-shaped second casing member 9 made of a steel and having a planar first wall 9*a* and a planar second wall 9*b* generally perpendicular thereto. The second wall 9*b* has formed therein a rectangular opening 9*c* serving as an air suction opening. Upon the assembly of the casing 10, the first wall 9*b* of the second casing member 9 is secured to the flange 8*j* on the second wall of the first casing member 8 and the second wall 9*b* of the second casing member 9 is secured to the edge of the first wall 8*a* of the first casing member 8 opposite to the second wall 8*a* thereof. Thereafter, side wall members 22, only one of which is shown in FIG. 3, are secured to the first and second casing members 8 and 9 so that the casing 10 is completed. A heat-exchanger 11 is disposed within a space defined in the casing 10 and located adjacent to the suction opening 9*c* in the second wall 9*b* of the second casing member 9. A propeller type fan 12 is disposed within the space in the casing 10 adjacent to the fan guard 8*c*. A motor 13 is disposed within the space in the casing 10 and is drivingly connected to the fan 12 through an output shaft 13*a*. As the fan 12 is rotated, air is drawn through the suction opening 9*c* and the heat-exchanger 11 into the space within the casing 10, whereupon the heat-exchanger is performed with respect to the air by means of the heat-exchanger 11. The air drawn into the space in the casing 10 is discharged through the fan guard 8*c*.

As shown in FIG. 4, a plurality of radially inward and outward slits 8*h* and 8*i* are formed in the first and second annular sections 8*m* and 8*p*, respectively of a planar plate member prior to the bending thereof into an L-shape to form the first casing member 8 having the first and second walls 8*a* and 8*b*. Each of the radially inward slits 8*h* has a radial slit section 8*h'*, a radially inner circumferential slit section 8*h''* continuously extending from the radial slit section 8*h'* to a location adjacent to the radial slit section of the adjacent slit along a radially inner circumference of the first annular section 8*m*, and a radially outer circumferential slit section 8*h'''* continuously extending from the radial slit section 8*h'* to a location adjacent to the radial slit section of the adjacent slit along a radially outer circumference of the first annular section 8*m*. Thus, the radial slit sections 8*h'* radially extend from the central disc-like section 8*d* to the ring-like section 8*f* in circumferentially equi-distantly spaced relation to each other. Each of the radially outward slits 8*i* has an arcuate slit section 8*i'* and a circumferential slit section 8*i''* continuously extending from the arcuate slit section 8*i'* to a location adjacent to the arcuate slit section of the adjacent slit along a radially inner circumference of the second annular section 8*p*. Thus, the arcuate slit sections 8*i'* extend from the ring-like section 8*f* to the outer peripheral section 8*n* in circumferentially equi-distantly spaced relation to each other. Subsequently, as shown in FIG. 5, the central disc-like section 8*d*, the ring-like section 8*f* and the first annular section 8*m* are located between a first pair of upper and lower dies 14 and 15, and the second annular section 8*p* and the outer peripheral section 8*n* are located between a second pair of upper and lower dies 16 and 17. The upper die 14 is then moved toward the lower die 15 to bend portions of the first annular section 8*m* each extending between the adjacent two radial slit sections 8*h'* to form radially inward louvers 8*e*. Then, while pressing the outer peripheral section 8*n* against the lower die 17 by the upper die 16, the upper and lower dies 14 and 15 are rotated in the clockwise direction 18 as viewed in FIG. 4 and are moved upwardly as shown by the arrow 19 relative to the second pair of dies 16 and 17. This causes portions of the second annular section 8*p* each extending between the adjacent two arcuate slit sections 8*i'* to be twisted and projected radially inwardly to form the radially outward louvers 8*f*. Then, the plate member having formed therewith the fan guard 8*c* is bent into an L-shape to form the first casing member 8 shown in FIG. 6. As described above, since the fan guard 8*c* is formed integrally with the first casing member 8, it is unnecessary to use a separate fan guard, resources are saved and the manufacturing steps are reduced and simplified.

The tooth die assembly for use in forming the radially inward and outward slits 8*h* and 8*i* includes an upper die having an arcuately segmental form and a circular lower die. The arcuate segmental die has formed on its working surface three teeth for the slits 8*h* and four teeth for the slits 8*i*. The arcuately segmental die is moved toward and away from the lower die while rotating the first casing member 8, thereby to form the radially inward and outward slits 8*h* and 8*i* over the entire peripheries of the first and second annular sections 8*n* and 8*p*, respectively. With such tooth die assembly, the arcuately segmental tooth die having formed thereon teeth for the slits is small-sized, the manufacturing cost of the tooth die which requires an accurately fine finishing machining is reduced, and the assembly and maintenance of the upper and lower dies are facilitated. In addition, such segmental tooth die can be used by only one, or a plurality of such segmental tooth dies can be used in combination. This enables the number of such segmental tooth dies to be freely selected in accordance with the number of the manufacturing lots.

Moreover, it will be clearly understood from FIG. 6 that the radially outward lourvers 8*g* are greater in number than the radially inward louvers 8*e*. This avoids a defect that each spacing between the adjacent two radially outward louvers 8*j* is broadened so as to enable a finger to pass through the spacings between the adjacent radially outward louvers 8*g*, and a defect that each spacing between the adjacent two radially inward louvers 8*e* is narrowed to increase the air-flow resistance. Thus, there is provided a fan guard 8*c* which has high safety and stable ari-flow resistance.

As described above, according to the method of the present invention, the fan guard 8*c* is manufactured by forming the radial and arcuate slit sections 8*h'* and 8*i'* in the first and second sections 8*m* and 8*p*, respectively, bending the portions of the first section 8*m* each extending between the adjacent two radial slit sections 8*h'* to form the louvers 8*e*, and moving the central disc-like section 8*d*, the ring-like section 8*f* and the first section 8*m* with respect to the outer peripheral section 8*n* while rotating the central disc-like, first and ring-like sections 8*d*, 8*m* and 8*f* relative to the outer peripheral section 8*n* to twist the portions of the second section 8*p* each extending between the adjacent two arcuate slit sections 8*i'* to form the louvers 8*g*. This enables the louvers 8*e* and 8*g* to be surely formed, enables the vibration noize during the operation to be prevented from occuring, and enables the manufacturing efficiency to be considerably improved.

What is claimed is:

1. A method of manufacturing a fan guard from a plate member, comprising the steps of:

forming a plurality of radially inward slits each having at least a radial slit section in a first section of said plate member, said first section extending between a central section of said plate member and a ring-like section thereof radially outwardly spaced from said central section, said radial slit sections radially extending in said first section from said central section to said ring-like section in circumferentially spaced relation to each other;

forming a plurality of radially outward slits each having at least an arcuate slit section in a second section of said plate member, said second section extending between said ring-like section and an outer peripheral section of said plate member radially outwardly spaced from said ring-like section, said arcuate slit sections extending from said ring-like section to said outer peripheral section in circumferentially spaced relation to each other;

bending portions of said first section each extending between the adjacent two radial slit sections to form louvers; and offsetting said central section, said first section and said ring-like section from said outer peripheral section while rotating said central section, said first section and said ring-like section relative to said outer peripheral section, to twist portions of said second section each extending between the adjacent two arcuate slit sections to form louvers.

2. A method defined in claim 1, wherein said plate member constitutes a part of a casing of an air conditioner.

3. A method defined in claim 1, wherein said arcuate slit sections are greater in number than said radial slit sections.

4. A method defined in claim 1, wherein a die having formed thereon teeth for forming said radially inward and outward slits is in the form of an arcuate segment, and wherein the steps of forming said radially inward and outward slits including moving said arcuately segmental die toward and away from a lower die so as to form the radially inward and outward slits over the entire periphery of said first and second sections while relatively rotating said plate member and said dies.

* * * * *